US005983789A

United States Patent [19]

Fogle

[11] Patent Number: 5,983,789

[45] Date of Patent: Nov. 16, 1999

[54] PRINTING BAND AND METHOD OF MAKING SAME

[75] Inventor: Ronald L. Fogle, Springboro, Ohio

[73] Assignee: Monarch Marking Systems, Inc., Dayton, Ohio

[21] Appl. No.: 09/238,986

[22] Filed: Jan. 28, 1999

[51] Int. Cl.[6] ..... B41J 1/20

[52] U.S. Cl. ..... 101/111; 400/146; 264/132

[58] Field of Search ..... 101/14, 93, 105, 101/111; 400/146; 264/129, 132; D64/10

[56] References Cited

U.S. PATENT DOCUMENTS

| | | | |
|---|---|---|---|
| D. 238,205 | 12/1975 | Pabodie | D64/10 |
| 3,418,929 | 12/1968 | Nelson | 101/111 |
| 3,796,152 | 3/1974 | Finke et al. | 101/111 |
| 3,835,771 | 9/1974 | Funk et al. | 101/111 |
| 3,977,321 | 8/1976 | Pabodie | 101/111 |
| 4,173,184 | 11/1979 | Hamisch, Jr. | 101/111 |
| 4,183,465 | 1/1980 | Dobras | 235/494 |
| 4,263,242 | 4/1981 | Jenkins | 264/132 |
| 4,337,698 | 7/1982 | Jenkins | 101/111 |
| 4,387,644 | 6/1983 | Jenkins | 101/111 |
| 5,415,479 | 5/1995 | Kuhn et al. | 400/146 |
| 5,820,809 | 10/1988 | Yajima et al. | 264/132 |

FOREIGN PATENT DOCUMENTS

| | | | |
|---|---|---|---|
| 0 045 360 | 2/1982 | European Pat. Off. | 101/111 |
| 57-38182 | 3/1982 | Japan | 101/111 |
| 2031807 | 4/1980 | United Kingdom | 101/111 |

*Primary Examiner*—Christopher A. Bennett
*Attorney, Agent, or Firm*—Joseph J. Grass

[57] ABSTRACT

There is disclosed a printing band and method of making same. The printing band has printing characters and human readable characters. The human readable characters and the portion of the band adjacent thereto are coated with a first coating while masking off the printing characters. Thereafter, the outer surfaces of the human readable character are coated with a second coating which is darker than the first coating. The human readable characters are easy to read and are not easily degraded during use.

20 Claims, 2 Drawing Sheets

PRINTING BAND AND METHOD OF MAKING SAME

BACKGROUND OF THE INVENTION

1. Field of the Invention

This invention relates to the field of printing bands and to method of making same.

2. Brief Description of the Prior Art

The following U.S. patents are made of record: Des. Nos. 238,205; 4,337,698; 3,418,929; 3,977,321; 4,173,184; and 4,263,242. U.S. Pat. Nos. 3,977,321 and 4,173,184 show typical environments in which printing bands have been used. It is known to highlight the outer surfaces of raised, embossing characters on credit cards.

The sleeve of molded connecting printing bands shown in FIGS. 1 and 2 of the drawings of the present invention is also prior art. The sleeve was comprised of raised printing characters and raised human readable characters. The sleeve was molded of a dark, essentially black elastomeric material. The human readable characters were coated with a light colored, e.g. white, coating or paint, and thereafter the coating was scraped, sanded or buffed from the outer surfaces of the human readable characters, rendering the human readable characters readable. This process had the disadvantages of producing dust and debris, creating scrap printing bands; and abrading the printing characters and smearing the semi-hardened coating, i.e. paint, onto the printing characters, in instances where the human readable characters and the printing characters were in an alternating pattern. Because the printing characters were raised to a greater extent than the human readable characters, the alternating pattern made the removal of the coating from the outer surfaces of the human readable characters especially problemsome.

SUMMARY OF THE INVENTION

It is a feature of the invention to provide an improved printing band which overcomes the above-mentioned deficiencies.

It is a feature of the invention to provide a printing band which has easy-to-read human readable characters even though the human readable characters are disposed between adjacent pairs of printing characters.

It is another feature of the invention to provide an improved method of making a printing band.

According to a specific embodiment of the invention, a flexible, molded, endless, elastomeric band includes raised human readable characters and raised printing characters. The human readable characters and at least adjacent portions of the band have a first coating of a color different from the color of the band. This is a second coating at essentially only the outer surfaces of the human readable characters, and the second coating is of a color different from the first coating. The first coating is preferably lighter in color than the second coating, and most preferably the first coating is white and the second coating is black. It is preferred that the printing characters are raised to a greater extent than the human readable characters.

It is a feature of the method of the invention to apply the first coating as indicated above, while at the same time preventing the first coating from being applied to the printing characters. The preferred method of one embodiment is to mask off the printing characters. The second coating is applied over the first coating at the outer surfaces of the human readable characters. The preferred method is to apply the second coating by hot stamping the human readable characters at their outer surfaces. In another embodiment where the printing characters are on one side or half of the band and human readable characters are on the other side or half of the band, the masking can be omitted.

BRIEF DESCRIPTION OF THE DIAGRAMMATIC DRAWINGS

DETAILED DESCRIPTION OF THE PREFERRED EMBODIMENTS

Figure 1:
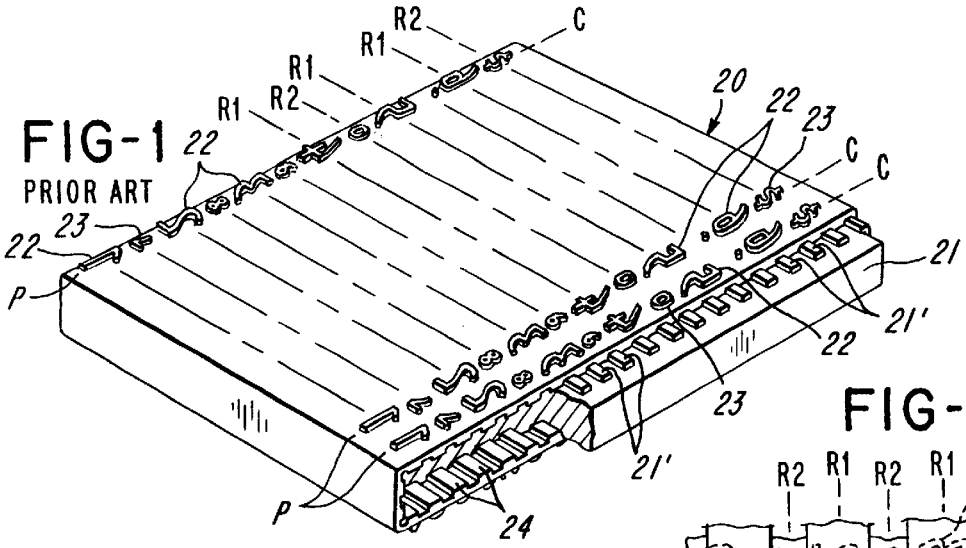
FIG-1 PRIOR ART
FIG. 1 is a perspective view of a molded sleeve of endless printing bands on a mandrel.
Figure 2:
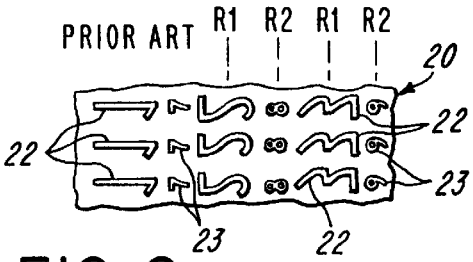
FIG-2 PRIOR ART
FIG. 2 is an enlarged fragmentary top plan view of the sleeve shown in FIG. 1.
Figure 4:
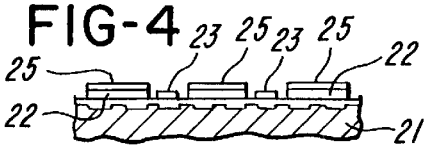
FIG. 4 is an end elevational view showing a fragment of the printing band, the strips of masking material and a fragment of the mandrel.
Figure 6:
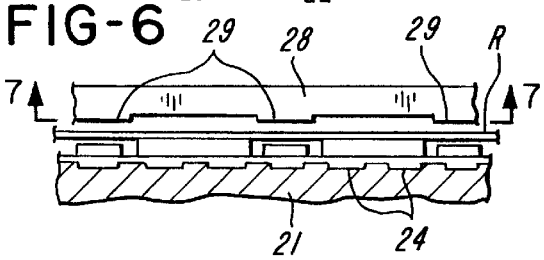
FIG. 6 is an end elevational view showing fragmentary portions of the sleeve, the mandrel, a coated ribbon and a heated anvil or die just prior to applying a second coating over the first coating at the outer surfaces of the human readable characters.
Figure 5:
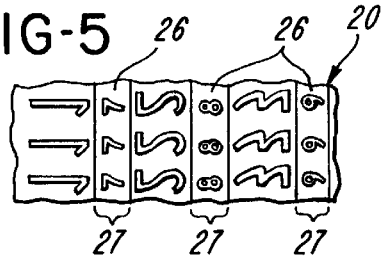
FIG. 5 is a view showing a fragmentary portion of the sleeve with the human readable characters and adjacent portions of the sleeve as having been coated with a first coating.
Figure 7:
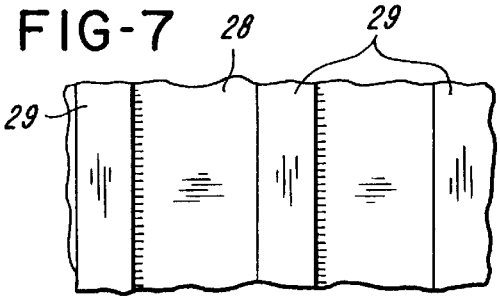
FIG. 7 is a view of the bottom of the anvil or die taken generally along line 7—7 of FIG. 6.
Figure 8:
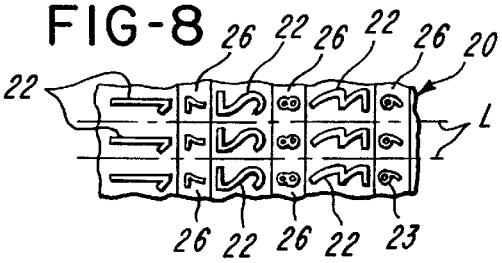
FIG. 8 is a view similar to FIG. 5, but showing slit lines along which the sleeve is to be slit to separate the sleeve into individual printing bands.

With reference to FIG. 1, there is shown a wide band or sleeve generally indicated at 20 comprised of an endless, flexible band molded of elastomeric material on a mandrel 21. The sleeve 20 includes a number of columns C of printing bands P which remain integral until slit along slit lines L (FIG. 8). The sleeve 20 has rows R1 of printing characters 22 and rows R2 of human readable characters 23 in an alternating pattern. The mandrel has parallel ribs 21' which form lugs 24 on the undersides of the printing band P. The lugs 24 are used in advancing the printing band P in the print head and also in detenting the printing band P in the print head. The molded sleeve 20 and the mandrel 21 shown in FIGS. 1 and 2 are prior art as acknowledged above.

Figure 3:
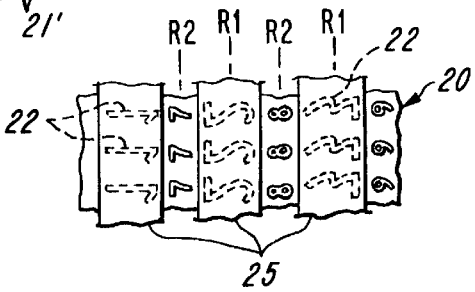
FIG. 3 is a top plan view similar to FIG. 2 but showing strips of masking material applied over only printing characters on the sleeve.
Figure 9:
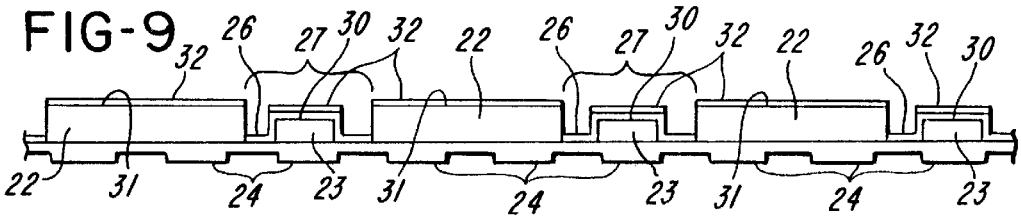
FIG. 9 is an enlarged, fragmentary end elevational view of the sleeve, showing in particular the first and second coatings.

According to the invention, and with reference to FIG. 3, strips of masking material 25 are positioned over and in contact with the printing characters 22. The printing characters 22 are hidden in FIG. 3 and thus are shown in broken lines. Next, a coating 26 typically comprised of paint is applied to the sleeve 20 at the places or zones 27 between the strips of masking 25. The masks 25 catch the excess paint and prevent the paint from coating the printing characters 22. Thus, the coating 26 is applied only to the raised human readable characters 23 and to the adjacent portions of the band 20 at zones 27. As best shown in FIG. 9, the coating 26 covers not only the entire raised human readable character 23, but also the adjacent portions between each adjacent pair of printing blocks 22.

The coating 26 is preferably of a different color than the color of the molded sleeve 20. The sleeve 20 is typically black, but sleeves of different, indeed, lighter colors are also known. The first coating 26 is preferably of a lighter color than the color of the sleeve 20. The color of the coating 26 is most preferably white, although other colors such as yellow or other light colors can also be used.

When one side of the sleeve 20 has been coated with the first coating 26, the strips 25 can be moved out of the way. The mandrel 21 can be turned over, and with the strips 25 positioned against the other side of the sleeve 20, and the remaining zones 27 can be coated with the first coating 26.

Next, a hot stamp ribbon R is positioned over the sleeve 20. A heated anvil or die 28 is positioned above the hot stamp ribbon R. The ribbon R has a coating which will transfer to the upper or outer surfaces of both the printing characters 22 and the human readable characters 23 when the heated anvil 28 presses the ribbon R into contact therewith. The hot stamping action will result in the second coating 32. It is noted that the anvil 28 has ridges or ribs 29 aligned with the outer surfaces 30 of the human readable characters 22. The raised printing characters 22 are higher than the raised human readable characters 23. The height of the ribs 29 is about equal to the difference in the height of the printing characters 22 and the human readable characters 23. It is apparent that the action of the heated anvil 28 against the ribbon R, which is positioned against the outer surfaces of the first coating 26 on the human readable characters 23 and outer surfaces 31 of the printing characters 22, will cause a second coating 32 to be applied. The second coating 32 is of a contrasting color with respect to the first coating 26 so, therefore, the human readable characters 23 will be easy to read. The coating 32 is preferably of a dark color, and most preferably black, although other colors can be used. The fact that the printing characters 22 are also coated is of no consequence because that coating 32 will wear off during use of the printing band P.

When one side of the sleeve 20 has been coated with the second coating 32, the sleeve 20 and the mandrel 21 can be turned over and the other side of the sleeve 20 can be coated with the second coating 32.

It is evident that when the printing band is used in a typical printer such as the labeler depicted in U.S. patent application Ser. No. 08/701,259 filed Aug. 22, 1996. The ink roller rolls across the printing character and it might also apply ink to the human readable character. Because ink is typically dark, i.e. black, at worst the ink roller will ink the already dark outer surface of the coated human readable characters. However, the background remains light in color, e.g., white. Moreover, the recessing of the human readable characters 23, as shown, namely because the height of the human readable characters 23 is less than the height of the printing characters 22, will help to minimize the amount of ink applied to the outer surfaces of the human readable characters 23.

Figure 10:
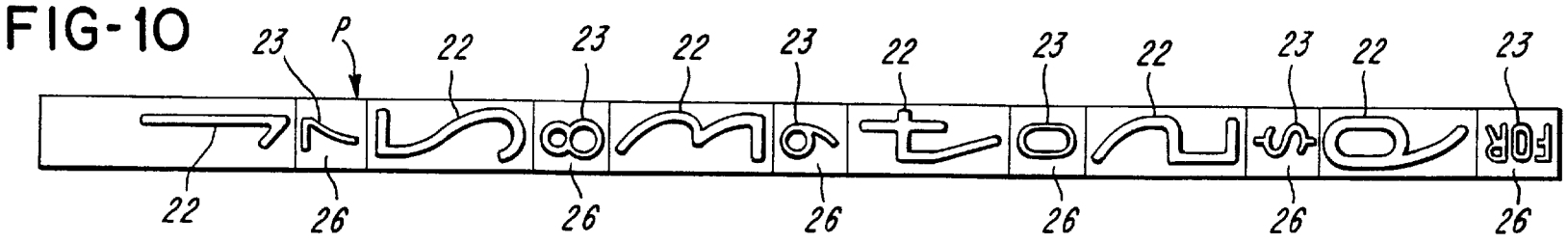
FIG. 10 is a top plan view of the printing band.
Figure 11:
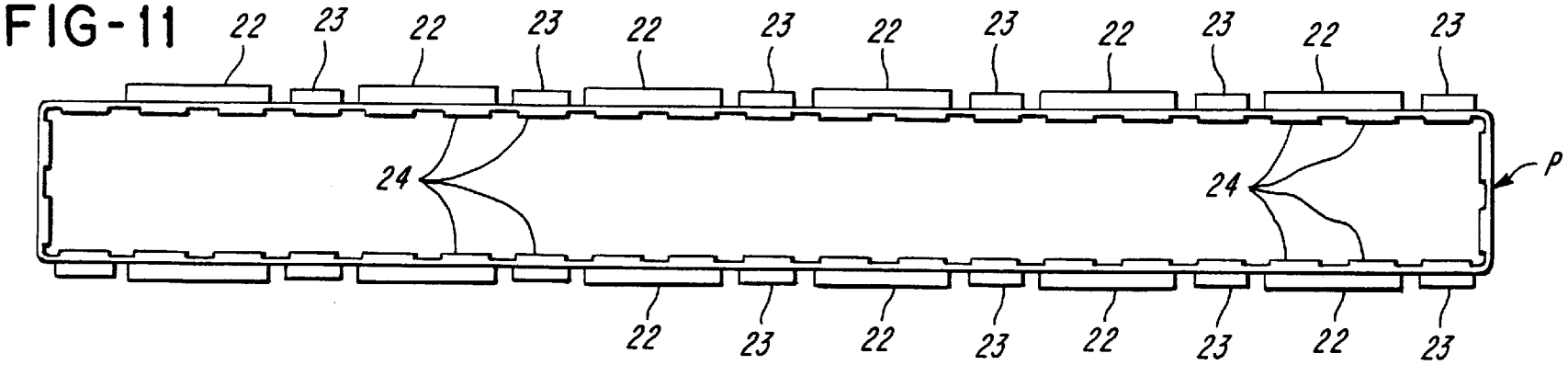
FIG. 11 is an end elevational view of the printing band.
Figure 12:
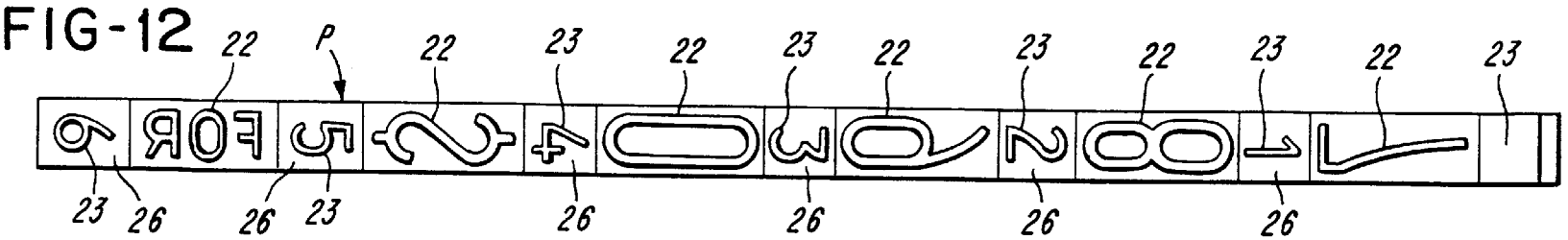
FIG. 12 is a bottom plan view of the printing band.

Now the sleeve 20 is ready to be slit along lines L in FIG. 8 to provide individual printing bands P. FIGS. 10 through 12 show the individual printing bands P in their finished form.

As is conventional, the sleeve 20 is made by first winding strands of thread or filaments on the mandrel and molding the elastomeric material into the thread. Such strands in the printing band are shown for example in prior art U.S. Pat. No. 3,977,321, however, they are not illustrated in the present application.

While as indicated above, the mandrel 21 with the sleeve 20 on it can be turned around to apply the first and second coatings 26 and 32 to both sides of the sleeve 20, the coating 26 can be applied by using two sets of masks and the coating 32 can be applied by using two sets of heated anvils and two hot stamp ribbons.

The first coating 26 can be applied by spraying, brushing or other suitable coating methods. The second coating 32 can be applied by methods other than hot stamping, such as by printing using liquid ink or paint.

The second coating 32 can be applied only to the human readable characters, if desired.

The coating 32 is preferably only applied to the outer surfaces or tops of the human readable characters 23, however the coating 32 can also flow around the sides of the human readable characters, if desired.

When making a printing band as in U.S. Pat. Nos. 4,173,184 or 4,387,644 wherein the printing characters are on one side or half of the band and the human readable characters are on the other side or half of the band, the masking of the printing characters can be omitted. In this event, the entire one side of the band with its human readable characters can be coated with the first coating and thereafter the second coating 32 can be applied to the outer surface of the human readable characters, and no coating is applied to the printing characters on the other side or half of the printing band.

Other embodiments and modifications of the invention will suggest themselves to those skilled in the art, and all such of these as come within the spirit of this invention are included within its scope as best defined by the appended claims.

I claim:

1. A printing band, comprising: a flexible, molded, endless, elastomeric band including raised human readable characters having outer surfaces and further including printing characters, wherein the human readable characters and at least adjacent portions of the printing band have a first coating of a color different from the color of the band, a second coating over the first coating at essentially only the outer surfaces of the human readable characters, and wherein the second coating is of a color different from the first coating.

2. A printing band, comprising: a flexible, molded, endless, elastomeric band including human readable characters having outer surfaces and further including printing characters, wherein the human readable characters and at least adjacent portions of the printing band have a first coating of a light color different from the color of the band, a second coating over the first coating at essentially only the outer surfaces of the human readable characters, and wherein the second coating is of a dark color.

3. A printing band as defined in claim 2, wherein the band is of a dark color.

4. A printing band as defined in claim 2, wherein the light color is white, and wherein the dark color is black.

5. A printing band, comprising: a flexible, molded, endless, elastomeric band including raised human readable characters having outer surfaces and further including raised printing characters, the human readable characters and the printing characters being arranged in an alternating pattern, wherein the printing characters are raised to a greater extent than the human readable characters, wherein the human readable characters and at least adjacent portions of the printing band have a first coating of a color different from the color of the band, a second coating over the first coating at essentially only the outer surfaces of the human readable characters, and wherein the second coating is of a color different from the first coating.

6. A printing band, comprising: a flexible, molded, endless, elastomeric band including raised human readable characters having outer surfaces and further including raised printing characters, the human readable characters and the printing characters being arranged in an alternating pattern, wherein the human readable characters and at least adjacent portions of the printing band have a first coating of a color different from the color of the band, a second coating over the first coating at essentially only the outer surfaces of the human readable characters, and wherein the second coating is of a color different from the first coating.

7. Method of making a printing band, comprising: molding an endless, flexible, elastomeric band including raised human readable characters having outer surfaces and further including printing characters, coating the human readable characters and at least adjacent portions of the printing band with a first coating of a color different from the color of the band, and coating over the first coating at essentially only the outer surfaces of the human readable characters with a second coating, and wherein the second coating is of a color different from the first coating.

8. Method of making a printing band comprising: molding an endless, flexible, elastomeric band including raised human readable characters having outer surfaces and further including printing characters, applying a first coating over the human readable characters and over at least adjacent portions of the printing band wherein the first coating is of a color different form the color of the band, and applying a second coating over the first coating at essentially only the outer surfaces of the human readable characters wherein the second coating is of a color different from the first coating.

9. Method of making a printing band, comprising: molding an endless, flexible elastomeric band including raised human readable characters having outer surfaces and further including raised printing characters, the human readable characters and the printing characters being arranged in an alternating pattern, wherein the printing characters are raised to a greater extent than the human readable characters, coating the human readable characters and at least adjacent portions of the printing band with a first coating of a color different form the color of the band, and coating over the first coating at essentially only the outer surfaces of the human readable characters with a second coating, and wherein the second coating is of a color different from the first coating.

10. Method of making a printing band, comprising: molding an endless, flexible elastomeric band including raised human readable characters having outer surfaces and further including raised printing characters, the human readable characters and the printing characters being arranged in an alternating pattern, wherein the printing characters, coating the human readable characters and at least adjacent portions of the printing band with a first coating of a color different from the color of the band, and coating over the first coating at essentially only the outer surfaces of the human readable characters with a second coating, and wherein the second coating is of a color different from the first coating.

11. Method as defined in claim 10, including preventing the printing characters from being coated by the first coating.

12. Method as defined in claim 10, including masking off the printing characters during application of the first coating.

13. Method of making a printing band, comprising: molding an endless, flexible elastomeric band including raised human readable characters having outer surfaces and further including raised printing characters, the human readable characters and the printing characters being arranged in an alternating pattern, wherein the printing characters are raised to a greater extent than the human readable characters, applying a first coating over the human readable characters and over at least adjacent portions of the printing band, wherein the first coating is of a color different from the color of the band, and applying a second coating over the first coating at essentially only the outer surfaces of the human readable characters, wherein the second coating is of a color different from the first coating.

14. Method of making a printing band, comprising: molding an endless, flexible elastomeric band including raised human readable characters having outer surfaces and further including raised printing characters, the human readable characters and the printing characters being arranged in an alternating pattern, applying a first coating over the human readable characters and over at least adjacent portions of the printing band, wherein the first coating is of a color different from the color of the band, and applying a second coating over the first coating at essentially only the outer surfaces of the human readable characters, wherein the second coating is of a color different from the first coating.

15. Method as defined in claim 14, including preventing the printing characters from being coated by the first coating.

16. Method as defined in claim 14, including masking off the printing characters during application of the first coating.

17. Method of making a printing band, comprising: molding an endless, flexible elastomeric band including raised human readable characters having outer surfaces and further including printing characters, coating the human readable characters and at least adjacent portions of the printing band with a first coating of a color different from the color of the band while preventing the first coating from coating the printing characters, and coating over the first coating at essentially only the outer surfaces of the human readable characters with a second coating, and wherein the second coating is of a color different from the first coating.

18. Method as defined in claim 17, wherein the first coating is of a light color and the second coating is of a dark color.

19. Method of making a printing band, comprising: molding an endless, flexible, elastomeric band including raised human readable characters having outer surfaces and further including printing characters, masking off the printing characters, coating the human readable characters and at least adjacent portions of the printing band with a first coating of a color different from the color of the band without coating the printing characters, and coating over the first coating at essentially only the outer surfaces of the human readable characters with a second coating, and wherein the second coating is of a color different from the first coating.

20. Method as defined in claim 19, wherein the first coating is of a light color and the second coating is of a dark color.

* * * * *

UNITED STATES PATENT AND TRADEMARK OFFICE

CERTIFICATE OF CORRECTION

PATENT NO. : 5,983,789

DATED : November 16, 1999

INVENTOR(S) : Ronald L. Fogle

It is certified that error appears in the above-indentified patent and that said Letters Patent is hereby corrected as shown below:

Column 5, line 35, "form" should be --from--; line 48, "form" should be --from--.

Signed and Sealed this

Thirtieth Day of January, 2001

*Attest:*

Q. TODD DICKINSON

*Attesting Officer*

*Director of Patents and Trademarks*